US005176810A

United States Patent [19]

Volotinen et al.

[11] Patent Number: 5,176,810

[45] Date of Patent: Jan. 5, 1993

[54] METHOD FOR PRODUCING METAL POWDERS

[75] Inventors: Heikki J. Volotinen, Lahti; Jyri J. Talja; Pekka A. Taskinen, both of Espoo, all of Finland

[73] Assignee: Outokumpu Oy, Helsinki, Finland

[21] Appl. No.: 710,052

[22] Filed: Jun. 4, 1991

[30] Foreign Application Priority Data

Jun. 5, 1990 [FI] Finland ..... 902816

[51] Int. Cl.[5] ..... C25C 3/26; C25C 5/04

[52] U.S. Cl. ..... 204/64 T; 75/358; 75/360; 75/369; 75/10.19; 204/64 R

[58] Field of Search ..... 204/64 T, 164, 64 R; 75/358, 359, 360, 369, 10.19

[56] References Cited

U.S. PATENT DOCUMENTS 2,778,726 1/1957 Winter, Jr. et al. ..... 75/612
2,937,979 5/1960 Wainer ..... 204/64 T
2,983,600 5/1961 Blue et al. ..... 75/360
4,231,790 11/1986 Hähn et al. ..... 75/359

FOREIGN PATENT DOCUMENTS 2039387 2/1971 Fed. Rep. of Germany .... 204/64 T
893687 5/1962 United Kingdom ..... 75/359

*Primary Examiner*—John Niebling
*Assistant Examiner*—Brian M. Bolan
*Attorney, Agent, or Firm*—Brooks Haidt Haffner & Delahunty

[57] ABSTRACT

The invention relates to a method for producing metal powders from reactive metals, when the employed raw materials are metal ions in a liquid phase. According to the invention, the metal ions are first reduced into metal in a molten salt electrolysis. The obtained reduction products are further subjected to a high-temperature treatment, for example by means of plasma, in order to improve the powder qualities of the metal. The metal to be treated is for instance titanium or zirconium.

6 Claims, No Drawings

METHOD FOR PRODUCING METAL POWDERS

The present invention relates to a method for producing metal powders from reactive metals, such as titanium, zirconium or hafnium, when the employed raw materials are metal ions contained in a liquid phase.

It is a known practice to produce reactive metal, such as titanium, by subjecting an electrolyte formed of molten halides, such as chlorides, to electrolysis. While treating titanium, there is generally used titanium tetrachloride, which is not, however, very soluble to the electrolyte. In order to provide for an effective electrolysis, the titanium tetrachloride must be reduced to a bivalent oxidation state, in which the product is soluble to the electrolyte. Another important factor in the electrolysis of titanium is the high reactivity of titanium ions to the chlorine that is being created in the electrolyte, both with dissolved atoms and with dispersed gas. In order to make the electrolysis succeed, the zone where chlorine is created must be separated from the rest of the electrolyte.

As for processing reactive metals into powder, it is rather problematic, too, because reactive metals have a strong tendency to react with the lining of the smelting furnace and with the atmosphere of the furnace. This causes impurities in the product. In order to eliminate these drawbacks, there are developed smelting methods without crucibles, such as the REP (Rotating Electrode Plasma) method, where a bar mechanically compacted of titanium sponge is smelted in a plasma source and spheroidized to powder. In case of a powdery raw material, however, the available methods are very complicated and include several process stages.

The object of the present invention is to achieve a method for producing metal powders, particularly an essentially simple method for producing essentially free-flowing metal powders from reactive metals, such as titanium, zirconium and hafnium, by first performing reduction in an electrolysis, advantageously molten salt electrolysis, into metallic form, and by treating the obtained porous, finely divided and crystalline reduction product at a high temperature. The essential novel features of the invention are apparent from the appended patent claims.

According to the invention, a reactive metal, such as titanium, is first subjected to molten salt electrolysis, such as molten halide electrolysis, in order to reduce the titanium into metallic form. The employed electrolyte is advantageously sodium chloride. Owing to the simple structure of sodium chloride, it does not create complexes that would disturb the lamination of titanium, and it forms, by condensating on the walls of the crucible, above the level of the bath, a solid, adhesive layer, which further provides a good protection for the material against the corrosive influence of gaseous chlorine. The temperature of the electrolyte in the electrolytic reduction process is advantageously within the range 800°-880° C. The conditions in the reduction process are advantageously chosen so that the electrolysis is carried out at a slight underpressure.

According to the method of the invention, the porous, finely divided and crystalline titanium is further treated without producing a particular intermediate product, such as a bar created by smelting, at a high temperature, advantageously by means of plasma, in order to transform the reduction product to essentially homogeneous powder particles.

The reduction product obtained in the method of the invention from the electrolysis treatment is porous and crystalline, and therefore its particle shape is very nonhomogeneous. This leads for instance to poor fluidity and low content density of the reduction product. By means of the high-temperature treatment carried out for the reduction product according to the method of the invention, the particle shape of the reduction product is changed to be essentially spherical. At the same time, the porous structure of the reduction product can be essentially condensed. Thus the specific surface of the powderous product created by means of the high-temperature treatment is smaller than that of the reduction product. Moreover, owing to the high-temperature treatment, the bulk density of the final product of the method of the present invention, i.e. metal powder, is increased in comparison to the reduction product, at the same time as its fluidity is essentially improved due to the spherical particles.

The invention is below explained with reference to the appended example. It is by no means, however, our wish to restrict the invention to this example only, but many changes and modifications are possible within the scope of the appended patent claims.

EXAMPLE

Titanium tetrachloride was electrolytically reduced in the presence of a sodium chloride electrolyte, at a slight underpressure within the temperature range 800°-880° C. As a product from the reduction process, there was obtained porous titanium sponge, which was crushed and screened to the particle size below 100 μm. The obtained raw material was pneumatically fed to plasma treatment by means of argon serving as the carrier gas. The employed plasma source was a rf (radio frequency) plasma source, which was operated at the frequency 3.5 MHz. The temperature of the argon plasma flame was about 10,000° C. The input power of the plasma source was 45 kVA, and the flow rate of the plasma gas was 2.4 $Nm^3/h$. The feeding of the material to be treated was arranged from the top, so that the material was congealed while falling down in the gas stream. The material was further subjected to cooling in a protective gas in the bottom part of the plasma reactor.

The product obtained from the plasma treatment was titanium powder composed of mainly spherical and essentially condensed particles. The titanium powder was essentially free-flowing, with a measured Hall fluidity of 1-1.5 g/s. Likewise, the obtained titanium powder had a high content density, because its measured bulk density was 1.5-2.0 $kg/cm^3$.

We claim:

1. A method for producing metal powders from reactive metals employing as raw materials metal ions in a liquid phase, comprising: (a) reducing the metal ions to metal by molten salt electrolysis; (b) subjecting the reduction product from step (a) to treatment at a temperature higher than the melting point temperature of the metal being treated in order to improve the powder qualities of the metal.

2. The method of claim 1 wherein the electrolyte used in the molten salt electrolysis is sodium chloride.

3. The method of claim 1 or 2, including carrying out the molten salt electrolysis within the temperature range 800°-880° C.

4. The method of claim 1 or 2 wherein the treatment of step (b) is carried out by means of plasma.

5. The method of claim 1 or 2 where the metal ion treated is titanium.

6. The method of claim 1 or 2 wherein the metal ion treated is zirconium.

* * * * *